United States Patent [19]

Trupp

[11] 4,239,198

[45] Dec. 16, 1980

[54] LOG HOLDER

[76] Inventor: William H. Trupp, 901 Sandy La., Gastonia, N.C. 28052

[21] Appl. No.: 48,292

[22] Filed: Jun. 13, 1979

[51] Int. Cl.[3] ..... B25B 1/24

[52] U.S. Cl. ..... 269/156; 269/20 A; 144/193 K

[58] Field of Search ..... 269/156, 203–204, 269/165, 49, 303, 42; 144/193 B, 193 C, 193 K, 193 R; 248/523, 524, 519

[56] References Cited

U.S. PATENT DOCUMENTS

| | | | |
|---|---|---|---|
| 2,152,058 | 3/1939 | King | 269/204 |
| 2,714,755 | 8/1955 | Wright | 269/165 |
| 2,840,331 | 6/1958 | Clifton | 248/523 |
| 3,357,697 | 12/1967 | Zanitsch | 269/203 |
| 4,168,825 | 9/1979 | Primmer | 269/42 |

*Primary Examiner*—Robert C. Watson

*Attorney, Agent, or Firm*—Leitner, Palan, Lyman, Martin & Bernstein

[57] ABSTRACT

A holder for supporting a log in a vertical position to be split. The holder is formed of three interconnected horizontally extending support members and an adjustable retainer having a curved collar thereon is slidably mounted on each support member to hold the log in position. A screw or wedge locking means is used to hold the adjustable retainers in the desired position on the support members.

6 Claims, 9 Drawing Figures

FIG. 1
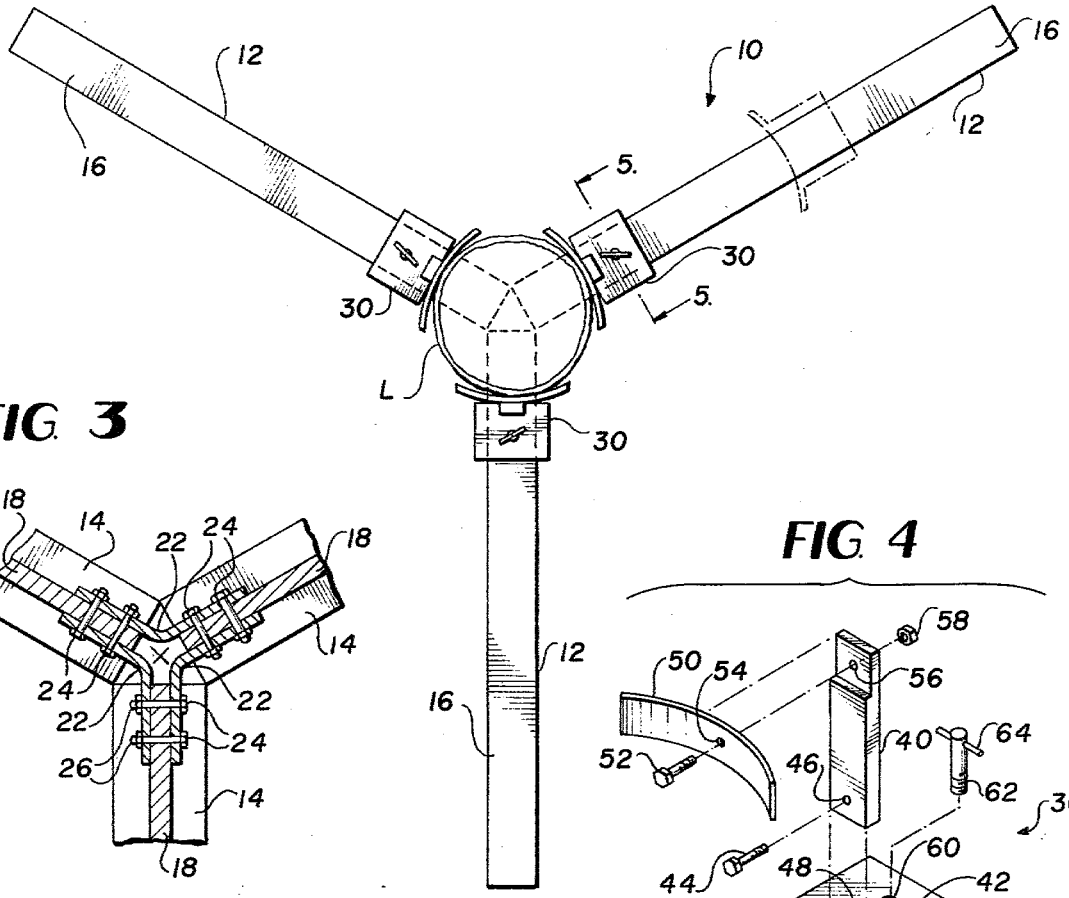
FIG. 3
FIG. 4
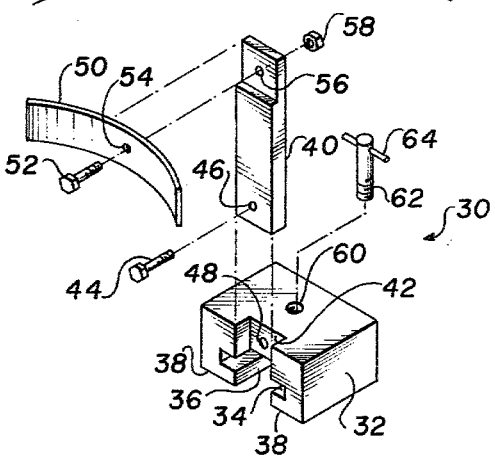
FIG. 2
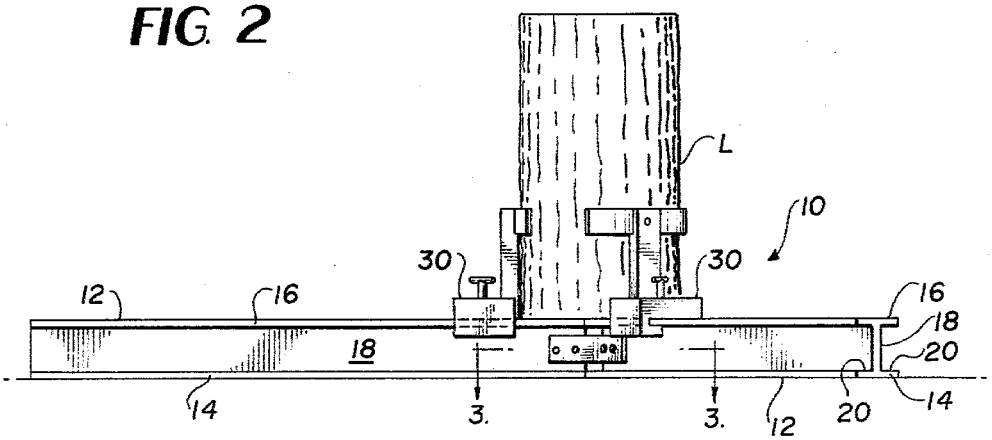

FIG. 5
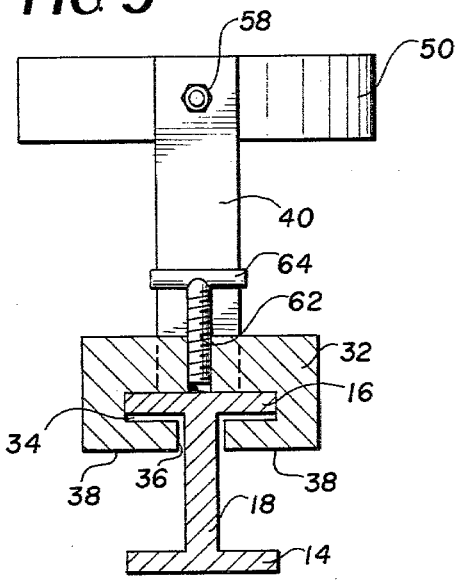
FIG. 6
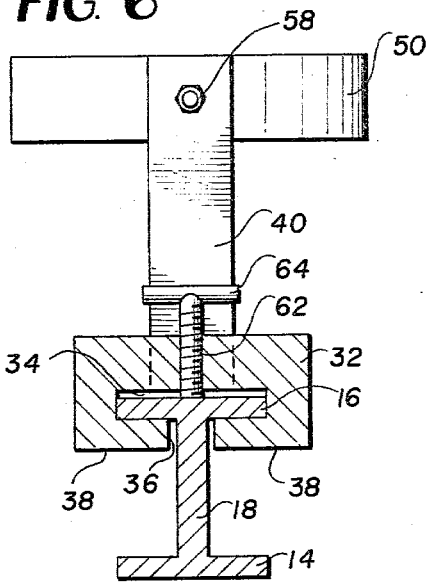
FIG. 7
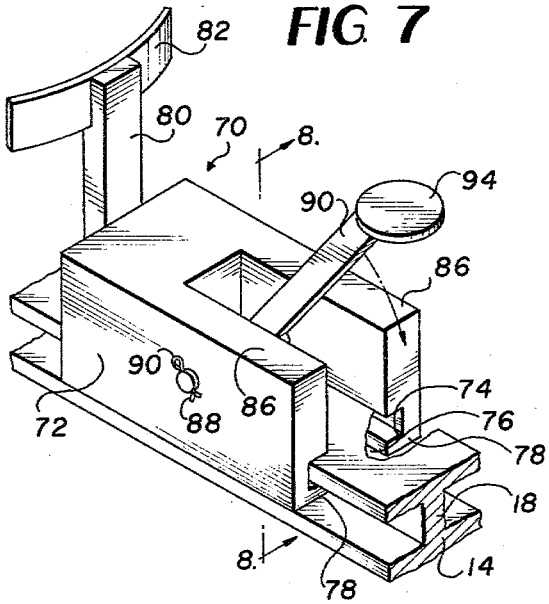
FIG. 8
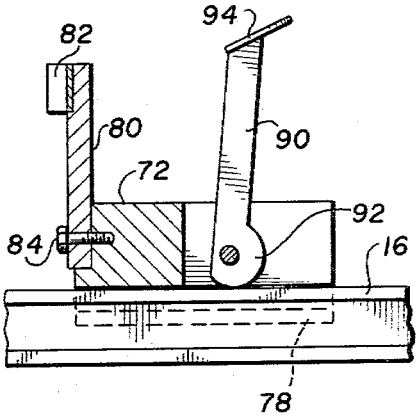
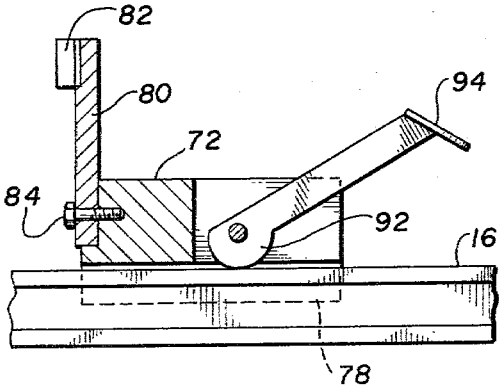
FIG. 9

LOG HOLDER

BACKGROUND OF THE INVENTION

This invention relates to improvements in a holder for supporting a log in a vertical position to eliminate the necessity of holding the log with a hand or foot while splitting the log for use in fireplaces and the like.

With the increased use of wood as an energy source, more and more people are finding their own sources of wood, cutting the wood into logs of about two foot lengths, and then splitting the logs into three or four sections. Although an experienced woodcutter can easily split wood using a wedge and a maul, the novice woodcutter will encounter a great deal of difficulty in both supporting the log in a proper position and in manipulating the wedge and maul.

Although various log cutting machines have been invented, such as shown in U.S. Pat. Nos. 1,701,001 and 3,982,572, these devices include a cutting tool and therefore, would be expensive to manufacture and they would require a great deal of storage space.

There thus exists a need for a relatively inexpensive log holder which will assist a woodcutter by supporting a log in the proper splitting position. Additionally, the log holder should be relatively easy to disassemble so that it can be stored in a small space.

OBJECTS OF THE INVENTION

It is an object of the invention to provide a new and improved log holder for use in splitting logs.

It is another object of the invention to provide a log holder which can be easily adjusted to hold different sizes of logs.

It is still another object of the invention to provide a log holder which can be quickly disassembled so that it can be stored in a relatively small area.

A further object of the invention is to provide a log holder that is simple and inexpensive to manufacture and which is composed of a minimum of easily assembled parts.

SUMMARY OF THE INVENTION

The above outlined objectives as well as other objects and features of the present invention are accomplished by a log holder formed of three interconnected horizontally extending support members which in addition to providing a base for the log to be split, also provide a surface for sliding retainers which are adjustably mounted on the support members. A screw or wedge locking means on the retainers is used to hold the retainers in their adjusted position on the support members. Each retainer includes a curved collar which is adapted to be moved against the log to thus support the log at a minimum of three positions around the log.

BRIEF DESCRIPTION OF THE DRAWINGS

FIG. 1 is a top plan view of the log holder shown with a log positioned in the holder.

FIG. 2 is a side elevational view of the log holder with a log positioned in the holder.

FIG. 3 is a sectional view taken on the line 3—3 in FIG. 2.

FIG. 4 is an exploded perspective view of one of the retainer members.

FIG. 5 is a sectional view taken along the line 5—5 in FIG. 1 and showing the retainer member in an unlocked condition on the log holder support structure.

FIG. 6 is a sectional view similar to FIG. 5 but showing the retainer in a locked condition on the log holder support structure.

FIG. 7 is a perspective view partially broken away of a modification of the retainer member.

FIG. 8 is a sectional view taken along the line 8—8 of FIG. 7 and showing the retainer member in an unlocked condition.

FIG. 9 is a sectional view similar to FIG. 8 but showing the retainer member in a locked condition.

DESCRIPTION OF THE PREFERRED EMBODIMENTS

Referring now to the drawings in detail, wherein like reference numerals indicate like parts throughout the several figures, reference numeral 10 indicates the log holder of the present invention. The log holder 10 comprises three interconnected horizontally extending support members 12 with each support member 12 having a base flange 14, an upper flange 16, and a web 18 connecting the flanges. A pair of grooves or channels 20 are thus formed on each side of the web 18. The support members 12 are interconnected together as best seen in FIG. 3 by the use of angular plates 22 which are suitably connected to the adjacent webs 18 of the support members 12 by the use of suitable bolts 24 and nuts 26. The support members 12 are arranged symetrically about vertical axis X as shown in FIG. 3, with the outer flange edges preferably touching each other to provide a more stable support; however, the support members 12 need not be touching but should be sufficiently close so that the portions of upper flanges 16 closest to axis X will act as a base for the log L to rest upon, as shown in FIGS. 1 and 2.

To hold the log L in position, a retainer 30 is provided for each support member 12. The retainer 30, as shown in FIGS. 1 and 2, and in FIG. 4 in an exploded view, comprises a shoe portion 32 having a T-shaped slot in the lower portion thereof consisting of a horizontal opening 34 and a vertical opening 36. A pair of opposing legs 38 are thus formed by the T-shaped slot. A collar support 40 is secured within recess 42 in shoe portion 32 by a suitable threaded fastener 44 which passes through opening 46 in collar support 40 and into a threaded opening 48 in shoe portion 32. A curved collar 50 is attached to the collar support 40 by a suitable threaded fastener 52 which passes through opening 54 in collar 50 and through opening 56 in collar support 40 and which is secured by a nut 58.

The retainer 30 is adapted to slide upon upper flange 16 with legs 38 extending underneath flange 16 and into channels 20. The horizontal opening 36 of retainer 30 is formed slightly greater than the width of upper flange 16 to enable the retainer 30 to freely slide on the upper flange 16 until the locking means on the retainer is actuated. The locking means comprises an internally threaded opening 60 extending from the upper surface of the retainer 30 to the horizontal opening 36. A bolt 62 having finger portions 64 is threaded into opening 60 and is of longer dimension than opening 60 so that the bolt substantially extends above the upper surface of retainer 30.

When it is desired to lock the retainer 30 into position on support 12, the bolt 62 is screwed down into opening 60 until the bottom of bolt 62 extends out of opening 60 and against upper flange 16, at which time the legs 38 of the retainer 30 will be upwardly moved to press against the bottom surface of flange 16. Thus, as clearly shown in FIG. 6, the retainer 30 is held in position by both the bottom of bolt 62 pressing against the upper surface of upper flange 16 and by legs 38 pressing against the bottom surface of upper flange 16. Each retainer 30 can be quickly moved and locked into the desired position to place the curved collar 50 against the log L as shown in FIGS. 1 and 2.

A modification of the retainer 30 is shown in FIGS. 7, 8 and 9 and is indicated generally by reference numeral 70. The retainer 70 is similar to retainer 30 in most respects and includes a shoe portion 72 having a T-shaped slot in the lower portion thereof consisting of a horizontal opening 74 and a vertical opening 76 thus forming a pair of opposed legs 78. A collar support 80 having a curved collar 82 is attached to shoe portion 72 by bolt 84. The retainer 70 differs from retainer 30 in the particular means to lock the retainer 70 onto the support 12. The locking means for retainer 70 includes spaced apart side portions 86 on shoe portion 72 through which a pin 88 is rotatably held such as by cotter pins 90 extending through suitable openings in the ends of pin 88. Secured on pin 88 is a wedge member 90 having at the end adjacent pin 88 an enlarged abutment 92 and at its other end an operating portion 94 adapted to be pressed upon by the user's hand or foot. When it is desired to lock the retainer 70 in position on support member 12, the operating portion 94 is downwardly pressed, thus rotating wedge member 90 and causing enlarged abutment 92 to press against the upper surface of flange 16, at which time the legs 78 of the retainer 70 will be upwardly moved to press against the bottom surface of flange 16. Thus, the retainer 70 is held in position by both the enlarged abutment 92 pressing against the upper surface of upper flange 16 and by legs 78 pressing against the bottom surface of upper flange 16, as clearly seen in FIG. 9.

It will thus be seen that the objects set forth above are efficiently attained and since certain changes may be made in the above construction without departing from the scope of the invention, it is intended that all matter contained in the above description or shown in accompanying drawings shall be interpreted as illustrative and not in a limiting sense.

What is claimed is:

1. A log holder for supporting a log in a vertical position comprising base means and a plurality of retainer means slidable on said base means, said retainer means including locking means for adjustably locking said retainer means to the base means and collar means for contacting the log, said base means including at least three interconnected, horizontally extending supports, each support having a lower planar portion, an upper planar portion and a web interconnecting said lower and said upper planar portions and one of said retainer means being slidably mounted on each of said supports, said retainer means further including a shoe portion having a T-shaped slot in the lower portion thereof, said T-shaped slot defining a first planar surface and a pair of oppositely projecting legs, said legs spaced from and beneath said upper planar portion of said support and adapted to move up and into frictional engagement with said upper planar portion when said locking means is actuated, said T-shaped slot extending through the complete lower portion of said shoe portion, said locking means including a first means adapted to be moved into the horizontal opening portion of said T-shaped slot, and against the upper planer portion of said support, whereby the shoe portion is raised to bring said legs of said shoe portion into frictional engagement with said support upper planar portion, said locking means further including a second means affixed to said first means to facilitate the movement of said first means.

2. The log holder of claim 1 wherein said locking means further includes a threaded opening in said shoe portion and said locking means first means comprises an externally threaded bolt.

3. The log holder of claim 2 wherein said second means comprises a finger portion integrally formed with said first means.

4. The log holder of claim 1 wherein said locking means first means includes a wedge member pivotally mounted on said shoe portion.

5. The log holder of claim 4 wherein said second means includes an operating portion integrally formed with said wedge member.

6. A log holder for supporting a log in a vertical position comprising base means and a plurality of retainer means slidable on said base means, said retainer means including locking means for adjustably locking said retainer means to the base means and collar means for contacting the log;

said base means including at least three interconnected, horizontally extending supports, each support having a lower planar portion, an upper planar portion and a web interconnecting said lower and said upper plannar portions and one of said retainer means being slidably mounted on each of said supports;

said retainer means further including a shoe portion having a T-shaped slot in the lower portion thereof, said T-shaped slot defining a first planar surface and a pair of oppositely projecting legs, said legs spaced from and beneath said upper planar portion of said support and adapted to move up and into frictional engagement with said upper planar portion when said locking means is actuated.

* * * * *